United States Patent [19]

Billman et al.

[11] Patent Number: 5,018,646

[45] Date of Patent: May 28, 1991

[54] SQUEEZABLE FLUID CONTAINER

[75] Inventors: Fred L. Billman, Racine, Wis.; Mark D. Jamison, Zion, Ill.; Russell B. Wortley, Racine, Wis.

[73] Assignee: S. C. Johnson & Son, Inc., Racine, Wis.

[21] Appl. No.: 614,057

[22] Filed: Nov. 13, 1990

Related U.S. Application Data

[63] Continuation of Ser. No. 275,457, Nov. 23, 1988, abandoned.

[51] Int. Cl.[5] ..... B65D 35/08

[52] U.S. Cl. ..... 222/107; 222/92; 222/541; 383/104; 383/906

[58] Field of Search ..... 222/92, 94, 105, 107, 222/541; 383/906, 104

[56] References Cited

U.S. PATENT DOCUMENTS

| | | |
|---|---|---|
| Re. 24,251 | 12/1956 | Kaplan et al. . |
| 720,718 | 2/1903 | Maddock et al. . |
| 2,517,027 | 9/1946 | Rado . |
| 2,707,581 | 5/1955 | Kaplan et al. . |
| 2,750,075 | 6/1956 | Land et al. . |
| 2,826,025 | 3/1958 | Swartz . |
| 2,886,931 | 5/1959 | Karpowicz, Jr. . |
| 2,948,998 | 8/1960 | Pfeiffer . |
| 3,009,498 | 11/1961 | Fohr . |
| 3,137,419 | 6/1964 | Davy . |
| 3,141,574 | 7/1964 | Donoghue . |
| 3,164,186 | 1/1965 | Weber et al. . |
| 3,184,121 | 5/1965 | Volckening . |
| 3,197,073 | 7/1965 | Gondra et al. . |
| 3,224,650 | 12/1965 | Willits, Jr. . |
| 3,228,170 | 1/1966 | Eisenstadt . |

(List continued on next page.)

FOREIGN PATENT DOCUMENTS

| | | |
|---|---|---|
| 656241 | 1/1963 | Canada . |
| 1066427 | 4/1967 | United Kingdom . |
| 1254761 | 11/1971 | United Kingdom . |
| 1389552 | 4/1975 | United Kingdom . |
| 1463094 | 2/1977 | United Kingdom . |
| 2130996A | 6/1984 | United Kingdom . |
| 88/02339 | 4/1988 | World Int. Prop. O. . |
| 8805013 | 7/1988 | World Int. Prop. O. . |

OTHER PUBLICATIONS

Walker, J., "The Troublesome Teapot Effect" *Scientific American*, vol. 251, No. 4 (Oct. 1984), pp. 144–152.

*Primary Examiner*—Robert P. Olszewski
*Assistant Examiner*—Steven M. Reiss

[57] ABSTRACT

An improvement in certain types of fluid containers is disclosed. The improvement is particularly directed to a certain type of squeezable fluid container that is made of a flexible plastic material. Such a fluid container defines a longitudinal axis and a cavity for containing a dispensable fluid. The fluid container has flexible side walls, a sealed bottom, a pair of spaced-apart sealed deformable side-edge margins, and a sealed deformable upper-edge margin which is unitary with an upper-edge portion of each of the side-edge margins and which defines a fluid-discharge passageway that communicates with the fluid cavity. The improvement comprises an indent, defined by at least one of the side-edge margins, for dividing the fluid cavity into two fluid chambers along the longitudinal axis. The two chambers are in fluid communication with each other. One of the two fluid chambers is located adjacent to, and is in fluid communicaton with, the fluid passageway. The transverse cross-sectional area of the one fluid chamber, which is in fluid communication with the fluid passageway, is greater than the transverse cross-sectional area of the fluid cavity in the vicinity of the indent. The indent is so located relative to the upper-edge margin that fluid communication between the fluid passageway and the one fluid chamber adjacent thereto is maintained when application of a predetermined fluid-discharging squeezing pressure upon the fluid container sidewalls causes deformation of the container side-edge margin in the vicinity of the indent.

2 Claims, 4 Drawing Sheets

U.S. PATENT DOCUMENTS

| | | | |
|---|---|---|---|
| 3,245,587 | 4/1966 | Brown . | |
| 3,268,152 | 8/1966 | Swartz . | |
| 3,269,617 | 8/1966 | Goth . | |
| 3,278,085 | 10/1966 | Brown . | |
| 3,313,472 | 4/1967 | Tjerneld et al. . | |
| 3,331,421 | 7/1967 | Lambert . | |
| 3,354,611 | 11/1967 | Powell . | |
| 3,357,632 | 12/1967 | Stanforth . | |
| 3,374,939 | 3/1968 | McMenimen . | |
| 3,380,646 | 4/1968 | Doyen et al. | 383/104 |
| 3,412,918 | 11/1968 | Sherman | 383/104 |
| 3,418,059 | 12/1968 | Robe | 222/107 |
| 3,423,902 | 1/1969 | Stroop . | |
| 3,465,921 | 9/1969 | Mullan . | |
| 3,473,532 | 10/1969 | Eisenberg . | |
| 3,635,376 | 1/1972 | Hellstrom | 222/541 |
| 3,645,423 | 2/1972 | DeGraw . | |
| 3,651,995 | 3/1972 | Chaney . | |
| 3,711,011 | 1/1973 | Kugler . | |
| 3,726,436 | 4/1973 | Despain et al. . | |
| 3,741,439 | 6/1973 | Vehrs . | |
| 3,815,794 | 6/1974 | Carlisle . | |
| 3,823,849 | 7/1974 | Ruscitti . | |
| 3,862,684 | 1/1975 | Schmitt . | |
| 3,878,977 | 4/1975 | Carlisle . | |
| 3,904,107 | 9/1975 | Nishimura et al. . | |
| 3,913,789 | 10/1975 | Miller . | |
| 3,917,116 | 11/1975 | Mason . | |
| 3,964,604 | 6/1976 | Prenntzell . | |
| 4,069,951 | 1/1978 | Winckelmann . | |
| 4,085,886 | 4/1978 | Nishioka . | |
| 4,130,245 | 12/1978 | Bryson . | |
| 4,153,185 | 5/1979 | Nilson . | |
| 4,154,366 | 5/1979 | Acres . | |
| 4,163,509 | 8/1979 | Amneus . | |
| 4,171,755 | 10/1979 | Carlisle . | |
| 4,196,030 | 4/1980 | Ausnit . | |
| 4,215,524 | 8/1980 | Saylor . | |
| 4,245,788 | 1/1981 | Wright . | |
| 4,249,675 | 2/1981 | Nilson . | |
| 4,252,257 | 2/1981 | Herzig . | |
| 4,275,840 | 6/1981 | Staar . | |
| 4,312,689 | 1/1982 | Amneus . | |
| 4,331,264 | 5/1982 | Staar . | |
| 4,364,220 | 12/1982 | Rausing . | |
| 4,429,810 | 2/1984 | Hampel et al. . | |
| 4,430,751 | 2/1984 | Miller . | |
| 4,430,752 | 2/1984 | Miller . | |
| 4,446,994 | 5/1984 | Smith . | |
| 4,475,838 | 10/1984 | Cropton . | |
| 4,484,351 | 11/1984 | de Leeuwe et al. . | |
| 4,491,245 | 1/1985 | Jamison . | |
| 4,537,308 | 8/1985 | Hollander Jr. . | |
| 4,690,375 | 9/1987 | Vorhis . | |
| 4,717,046 | 1/1988 | Brogli . | |
| 4,718,738 | 1/1988 | Bell | 383/104 |
| 4,738,378 | 4/1988 | Oakley et al. | 222/82 |
| 4,749,108 | 7/1988 | Dornsbusch et al. . | |
| 4,753,371 | 6/1988 | Michielin et al. . | |
| 4,759,472 | 7/1988 | Strenger | 222/92 |
| 4,793,121 | 12/1988 | Jamison . | |
| 4,818,544 | 4/1989 | Seward | 222/541 |
| 4,886,674 | 12/1989 | Seward et al. | 426/79 |

SQUEEZABLE FLUID CONTAINER

This is a continuation of Ser. No. 07/275,457 filed on Nov. 23, 1988, now abandoned.

TECHNICAL FIELD OF THE INVENTION

The present invention is generally directed to a squeezable fluid container. The present invention, more particularly, is directed to an improvement in that type of squeezable fluid container which has flexible, sealed upper-edge and side-edge margins, and wherein the flexible upper-edge margin defines a fluid-discharge passageway.

BACKGROUND OF THE INVENTION

Many modern consumers prefer flexible plastic containers over traditional inflexible containers such as glass bottles or metal containers for a variety of reasons.

Glass bottles can crack, chip, break or explode—often at most inconvenient times. Metal containers can, at times, be difficult to open. Many metal containers, moreover, once open, can have sharp edges or burrs.

Certain viscous fluids, such as ketchup and certain salad dressings, furthermore, can often more readily be poured from flexible or plastic containers than from glass bottles or metal containers of comparable general shape. Also, many consumers are generally able to extract a greater percentage of fluid residue from a flexible or squeezable plastic container than would be possible were the fluid contained in certain inflexible containers of comparable volume. In certain storage situations, moreover, flexible containers can be squeezed into relatively tight nooks or crannies which would not otherwise accommodate an inflexible fluid container of comparable general shape. Finally, because flexible plastic containers, when empty, are generally more readily compactible than certain metal and most glass containers, relative ease of fluid container disposal can, at times, be an important consumer consideration in deciding which brand of a particular fluid product to purchase.

Thus, in light of a general preference by consumers for flexible plastic fluid containers, a variety of flexible plastic containers, designed to meet a number of specific consumer demands and to provide certain desirable features, have of late come into being.

U.S. Pat. No. Re. 24,251 to Kaplan et al., for example, discloses a fluid-dispensing container, made from two sheets of flexible plastic material, for containing desired amounts of liquid. Such a container is said to be particularly adapted for shipment in sealed condition, and is further said to be provided with a tearable strip along one end thereof to facilitate opening of the container. Such a strip, when so torn, can thus be utilized for purposes of dispensing the contained liquid from its container, as desired, upon application of a predetermined fluid-dispensing pressure to the sidewalls of the container. See also U.S. Pat. No. 4,717,046 to Brogli.

However, not all flexible plastic fluid containers need to made from two sheets of plastic, sealed together at their edge margins, as Kaplan et al. disclose. In U.S. Pat. No. 2,517,027 to Rado, for example, there is disclosed a collapsible tube-like container for certain viscous fluids such as pastes.

Another version of a tear-away, sealing strip is disclosed in U.S. Pat. No. 3,278,085 to Brown, which patent discloses a sachet container which is said to be "re-sealable". The sachet, also referred to as a so-called "pouch pack", is deformable and is generally utilized to contain, dispense and retain certain liquids, semi-liquids, pastes, and the like.

In U.S. Pat. No. 3,473,532 to Eisenberg, moreover, a bag-type of flexible plastic fluid container having a self-closing one-way valve is disclosed. Certain features which provide automatic retention of fluid contained by a flexible plastic container, after such container has been opened, are important design considerations in each of U.S. Pat. Nos. 3,815,794 and 3,878,977, both to Carlisle, U.S. Pat. No. 3,904,107 to Nishimura et al., each of U.S. Pat. Nos. 4,163,509 and 4,312,689, both to Amneus, and U.S. Pat. No. 4,252,257 to Herzig.

Originally-sealed fluid-discharge passageways which are openable upon application of moderate pressure to the sidewalls of the flexible-plastic fluid container are important design considerations in U.S. Pat. No. 3,913,789 to Miller and U.S. Pat. No. 4,537,308 to Hollander, Jr.; and originally-sealed fluid passageways, openable other than by application of such pressure to the sidewalls of the fluid container, are important design considerations of the flexible plastic fluid containers disclosed in U.S. Pat. No. 3,917,116 to Mason and U.S. Pat. No. 4,491,245 to Jamison.

Simplicity of overall design can also be an important consideration, particularly when it is desirable to reduce manufacturing cost of each flexible plastic fluid container unit. Thus, while it is possible to manufacture fluid containers having necked-down fluid-discharge portions, as is disclosed in U.S. Pat. Nos. 3,815,794 and 3,878,977, both to Carlisle, and U.S. Pat. No. 4,163,509 to Amneus, it is in most situations desirable to produce flexible-plastic fluid containers that are generally rectangular in shape. Indeed, such a shape tends to reduce material waste and production cost per flexible-plastic fluid container unit. The flexible-plastic fluid containers disclosed in U.S. Pat. No. Re. 24,251 to Kaplan et al. and U.S. Pat. No. 4,491,245 to Jamison disclose flexible-plastic fluid containers that are generally rectangular in shape. Unfortunately, in flexible-plastic fluid containers of this type, undesired container deformation tends to interfere with desired fluid-discharge.

For example, in certain flexible plastic fluid containers—such as those having flexible sidewalls, a closed bottom, spaced-apart deformable side-edge margins, and a deformable upper-edge margin which is unitary with each of the side-edge margins and which defines a fluid-discharge passageway—deformation of that portion of the upper-edge margin defining the fluid-discharge passageway can occur upon application of pressure to the fluid container. Such deformation typically restricts fluid flow through the discharge passageway and thus is a matter of annoyance to the user. Moreover, and based upon the configuration of the particular fluid passageway, such deformation can at times substantially reduce the effective fluid-discharge rate from the container, whereby such fluid rate reduction renders the fluid container unacceptable for its intended use.

The present invention solves just this sort of a problem.

SUMMARY OF THE INVENTION

Briefly stated, the present invention is generally directed to an improvement in certain types of flexible-plastic fluid containers. More particularly, the present invention is directed to an improvement in a certain type of squeezable article of manufacture having deformable edge margins.

Such an article of manufacture defines a longitudinal axis and a cavity for containing a dispensable fluid. The article of manufacture has flexible sidewalls, a closed bottom, a pair of spaced-apart sealed deformable side-edge margins, and a sealed deformable upper-edge margin which is unitary with an upper-edge portion of each of the side-edge margins and which defines a fluid passageway that communicates with the fluid cavity.

The improvement comprises an indent, defined by at least one of the side-edge margins, for dividing the fluid cavity into two fluid chambers along the longitudinal axis.

The two chambers are in fluid communication with each other. One of the two fluid chambers is located adjacent to, and is in fluid communication with, the fluid passageway. The transverse cross-sectional area of the one fluid chamber, which is in fluid communication with the fluid passageway, is greater than the transverse cross-sectional area of the fluid cavity in the vicinity of the indent.

The indent is so located relative to the upper-edge margin such that fluid communication between the fluid passageway and the one fluid chamber adjacent thereto is maintained when application of a predetermined fluid-discharging squeezing pressure on the article sidewalls causes deformation of the article side-edge margin in the vicinity of the indent.

Additional features and advantages of the present invention are discussed in greater detail hereinbelow.

BRIEF DESCRIPTION OF THE DRAWINGS

Throughout the drawings, like reference numerals refer to like parts.

DETAILED DESCRIPTION OF THE PREFERRED EMBODIMENTS

While the invention will be described in connection with the illustrated preferred embodiments, it will be understood that it is not our intention to limit the present invention to these embodiments. On the contrary, the present invention is to cover all structural and/or functional alternatives or equivalents as defined by the appended claims.

Figure 1:
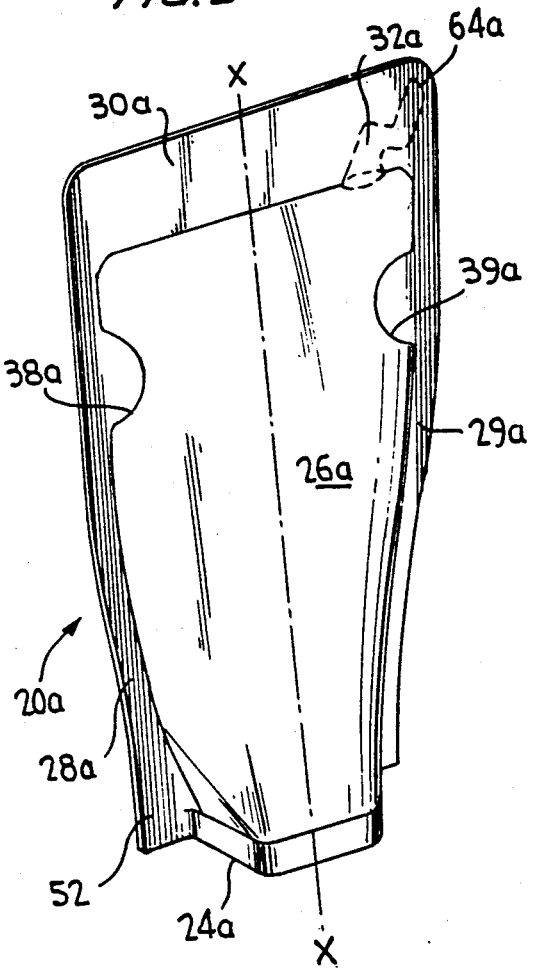
FIG. 1 is a perspective view of one embodiment of the fluid container of the present invention.
Figure 2:
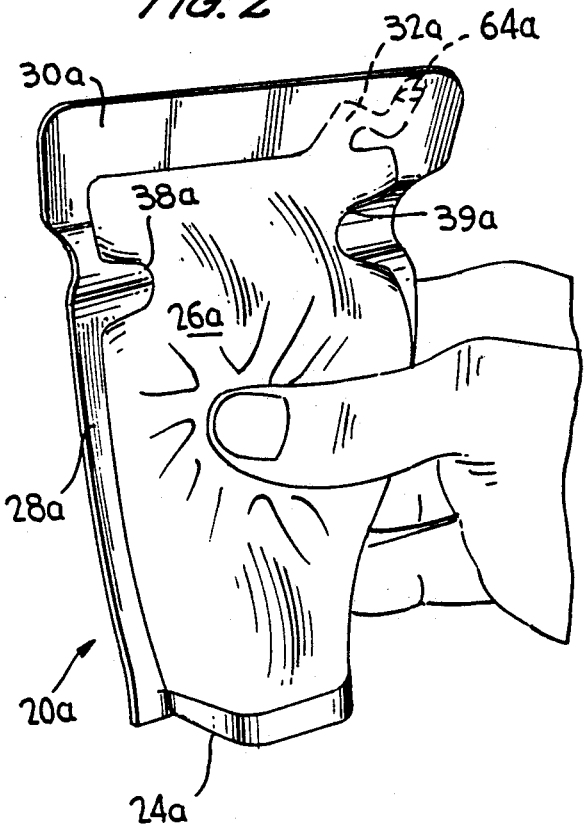
FIG. 2 is another perspective view of the fluid container shown in FIG. 1, illustrating side-margin deformation which occurs in the vicinity of the indents when a predetermined fluid-discharging pressure is applied to the sidewalls of the fluid container.

Referring initially to FIGS. 1 and 2, there is shown one embodiment of the flexible-plastic fluid container 20*a* of the present invention. Such container 20*a*, which defines a longitudinal axis X—X, comprises an upstanding sealed base or bottom 24*a*, flexible sidewalls 26*a*, a pair of sealed spaced-apart deformable side-edge margins 28*a* and 29*a*, and a sealed deformable upper-edge margin 30*a* which is unitary with an upper-edge portion of each of the side-edge margins 28*a* and 29*a*. The upper-edge margin 30*a* defines a fluid passageway 32*a*.

Figure 9:
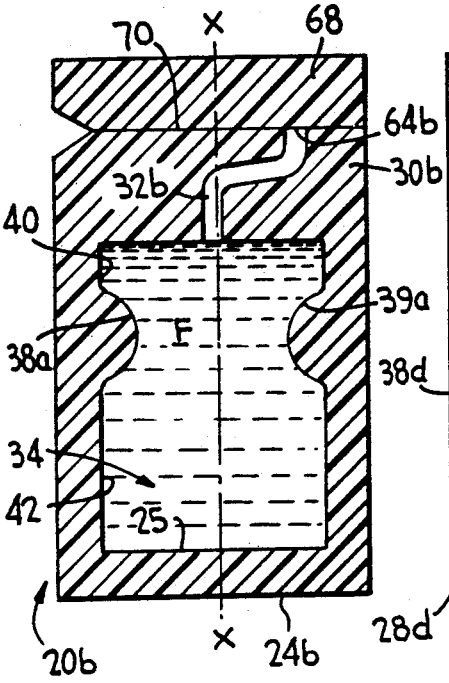
FIG. 9 is a frontal view, in section, of yet another embodiment of the fluid container of the present invention.

Another embodiment of the fluid container 20*b* of the present invention is shown in FIG. 9. This fluid container 20*b* is in the form of an envelope having a bottom 24*b* which is sealed along a bottom seam 25.

The sidewalls of the fluid container of the present invention define a cavity 34 for containing a dispensable fluid F. This is best seen by referring to FIG. 9 which is presented in section along longitudinal axis X—X. The fluid passageway 32*b*, shown in FIG. 9, is a different version of that fluid passageway 32*a* presented in FIGS. 1 and 2. The fluid-dispensing function, however, remains the same. The fluid passageway 32*b* communicates with the fluid cavity 34 (FIG. 9.)

The side-edge margins define indents 38*a* and 39*a* for dividing the cavity 34 into two fluid chambers 40 and 42 along the longitudinal axis X—X. (FIG. 9.) One of the fluid chambers 40 and 42, namely upper fluid chamber 40, is located adjacent to and is in fluid communication with the fluid passageway 32*b*. The cross-sectional area of the one fluid chamber 40 (such cross-sectional area being transverse to the longitudinal axis X—X) is greater than the transverse cross-sectional area of the fluid cavity in the vicinity of the indents 38*a* and 39*a*.

Figure 3A:
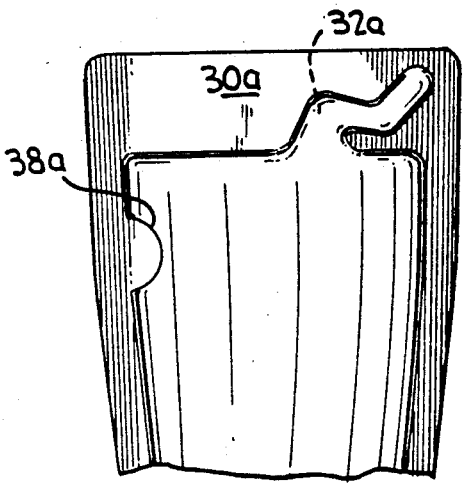
FIG. 3*a* is a partially-fragmented frontal view of another embodiment of the fluid container of the present invention.
Figure 3B:
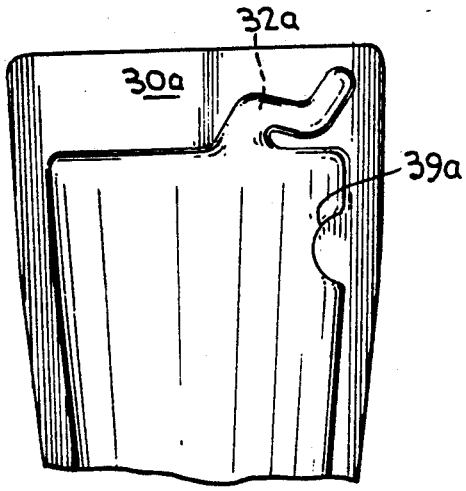
FIG. 3*b* is a partially-fragmented frontal view of yet another embodiment of the fluid container of the present invention.

FIGS. 3*a* and 3*b* show that the fluid container need only have one such indent. The single indent 38*a* can be in distal relation to the fluid passageway 32*a* (FIG. 3*a*) or the single indent 39*a* can be located adjacent to the fluid passageway 32*a* (FIG. 3*b*).

In any event, the indent is so located relative to the upper-edge margin 30*a* such that fluid communication between the fluid passageway 32*a* and the one fluid chamber adjacent thereto is maintained when application of a predetermined fluid-dispensing squeezing pressure upon the container sidewalls 26*a* causes deformation of the container side-edge margins in the vicinity of the indents. (Please refer to FIG. 2.)

Figure 6:
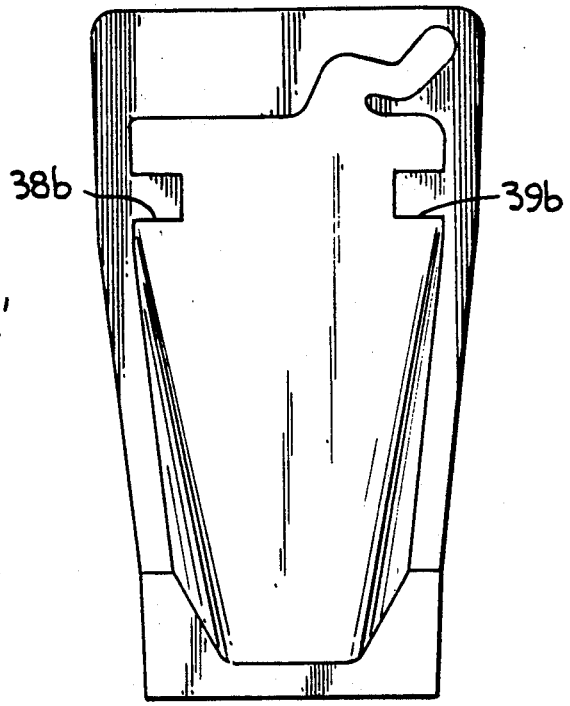
FIG. 6 is a frontal view of still another embodiment of the fluid container of the present invention.
Figure 7:
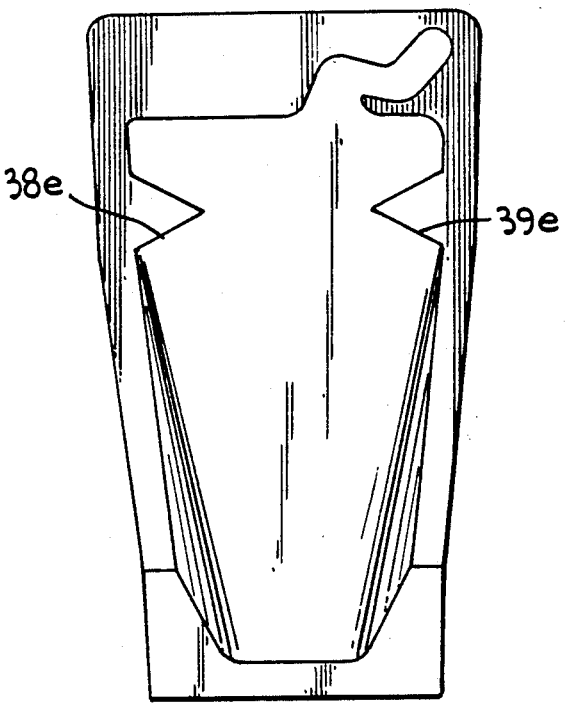
FIG. 7 is a frontal view of yet another embodiment of the fluid container of the present invention.

The indents can take a variety of shapes, in accordance with the present invention. For example, the container side-edge margins can define square-shaped or rectangular-shaped indents 38b and 39b (FIG. 6), triangular-shaped indents 38e and 39e (FIG. 7), etc.

Figure 8:
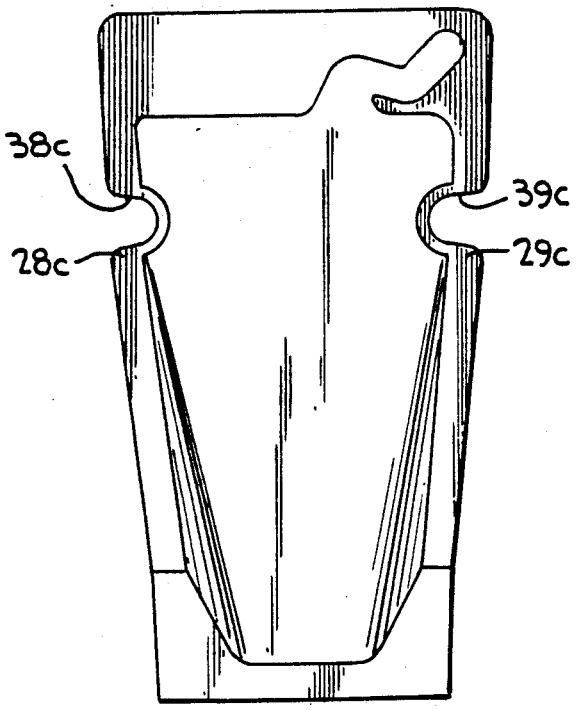
FIG. 8 is a frontal view of still another embodiment of the fluid container of the present invention.

Moreover, portions of the side-edge margins 28c and 29c defining the indents 38c and 39c can project inwardly as is shown in FIG. 8.

Figure 5:
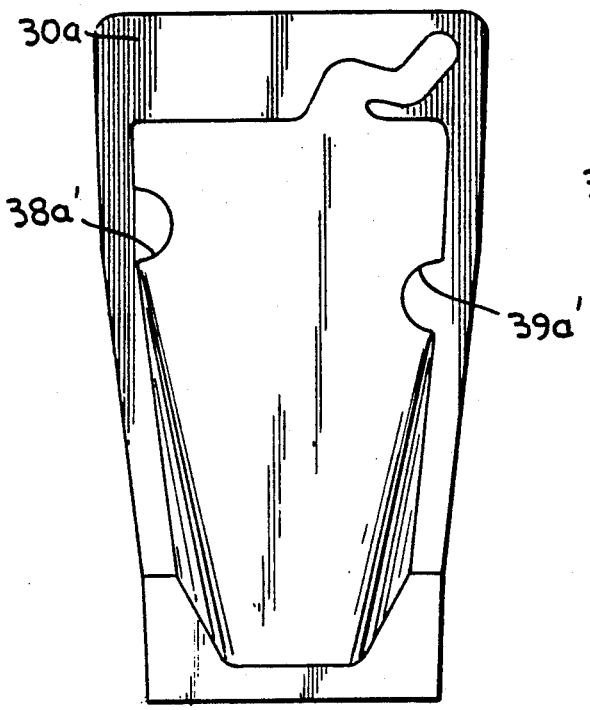
FIG. 5 is a frontal view of yet another embodiment of the fluid container of the present invention.

Still further, if the fluid container side-edge margins define two indents, namely indents 38a' and 39a', such indents 38a' and 39a' can be spaced somewhat differently from the upper-edge margin 30a, relative to each other, as is shown in FIG. 5, in accordance with the principles of the present invention.

As was briefly mentioned above, one embodiment of the fluid container 20a of the present invention has a base 24a which enables such embodiment of the fluid container to be free-standing, also referred to herein as "upstanding". (Please refer to FIGS. 1 and 2.)

Figure 4A:
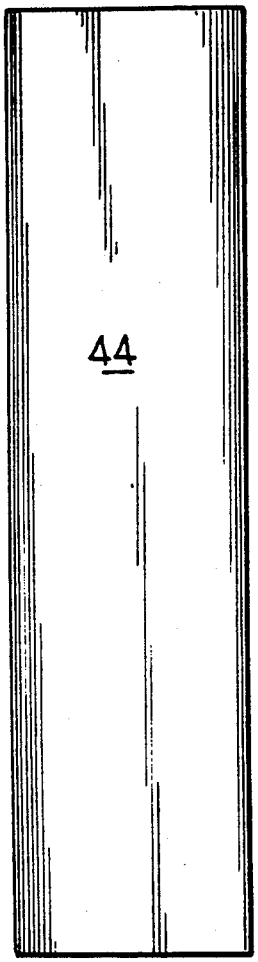
FIGS. 4*a* through 4*f* are a series of drawings, briefly illustrating how that embodiment of the fluid container which is shown in FIGS. 1 and 2 is made.
Figure 4B:
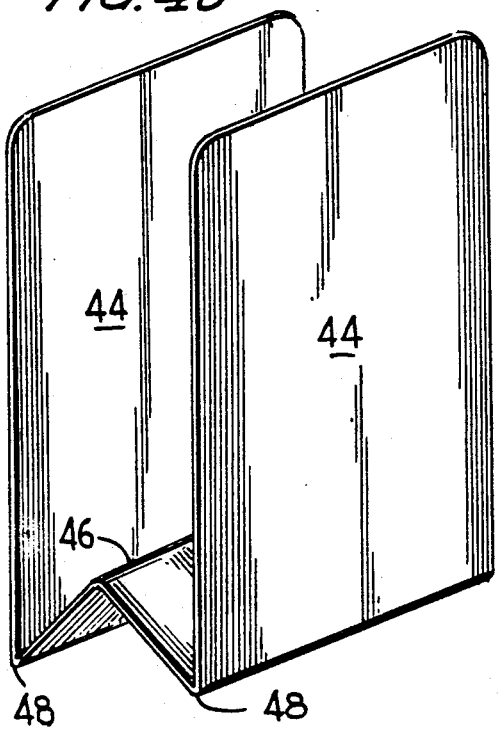
Figure 4C:
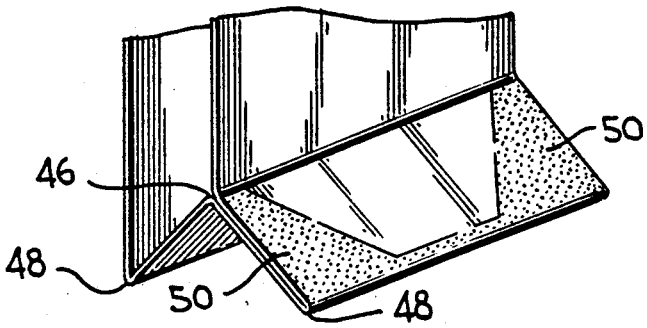
Figure 4D:
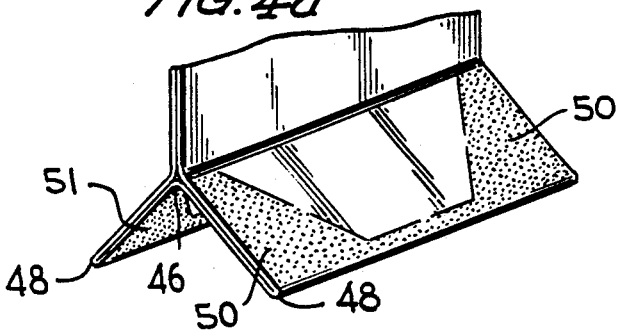
Figure 4E:
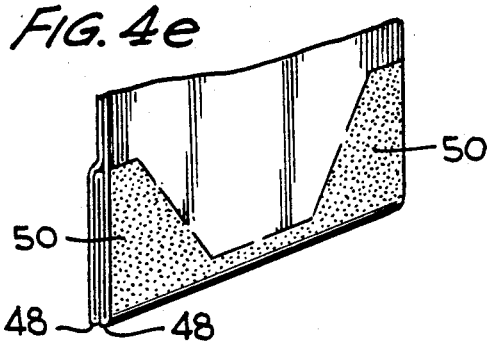
Figure 4F:
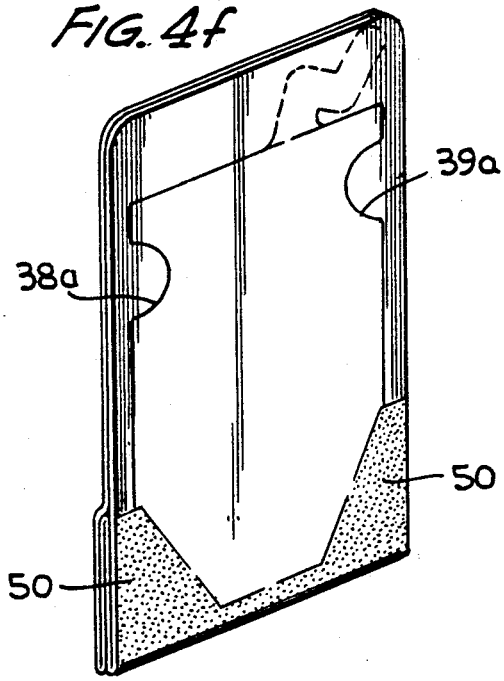

Reference is next invited to FIGS. 4a through 4f for purposes of briefly discussing how such a fluid container is made. Starting with an elongated strip of flexible plastic material 44 (FIG. 4a), oriented longitudinally, a transverse crease 46 is formed, and back-folds 48 so formed as to straddle the crease 46 and bring the opposite end portions of the elongated plastic material 44 into close proximity (FIG. 4b). Next, one pair of lower, side-edge margins 50 between the crease 46 and one back-fold 48 is sealed (FIG. 4c); then the other pair of lower, side-edge margins 51 is similarly sealed (FIG. 4d), thereby closing the bottom. Lower edge portions 52 of the thus-sealed side-edge margins are further sealed together so as to provide a free-standing base (FIG. 1). Next, the sides are sealed; and the container is filled with a predetermined dispensable fluid. Finally, the top is sealed, forming an upper-edge margin which defines the fluid-discharge passageway. (FIG. 4f.) In this manner, a free-standing fluid container, generally wider at the top than at the base, can thus be formed. (Please refer to FIGS. 5 through 8.)

Figure 12:
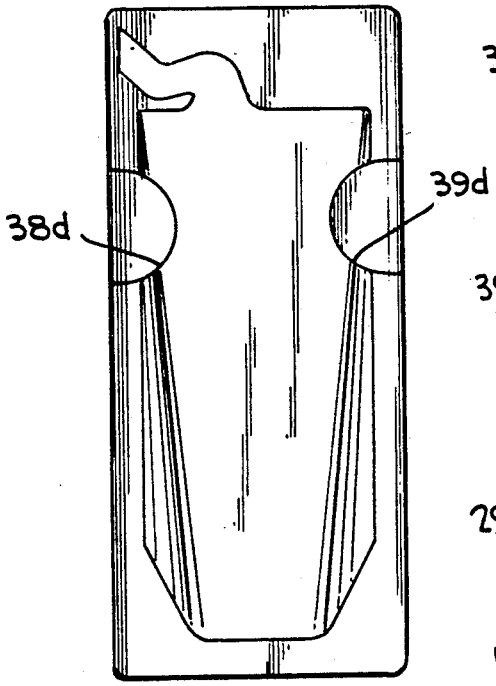
FIG. 12 is a frontal view of still another embodiment of the fluid container of the present invention.
Figure 13:
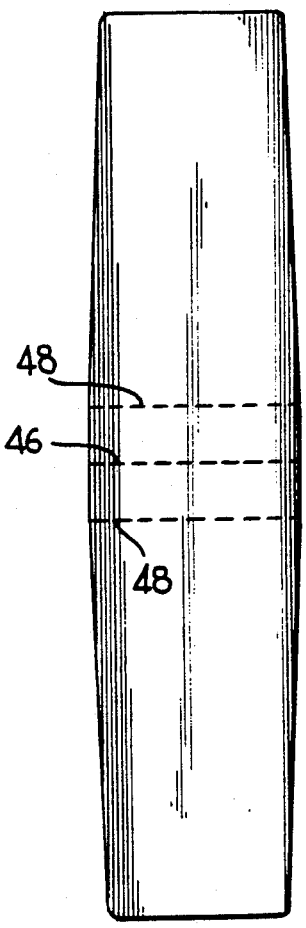
FIG. 13 is a drawing, briefly illustrating how that embodiment of the fluid container which is shown in FIG. 12 is made.

In certain situations, as in those cases where it would be advantageous to have the fluid containers be as closely packable to each other as possible, it will be desirable to have a fluid container which is generally rectangular in projected frontal view, as is shown in FIG. 12. Those skilled in the art can appreciate that it will accordingly be desirable to start out not with a generally rectangular elongated strip of flexible plastic material, as is shown in FIG. 4a, but rather with a strip that is generally wider in the vicinity of the crease 46 and back-folds 48, as is shown in FIG. 13.

Figure 10:
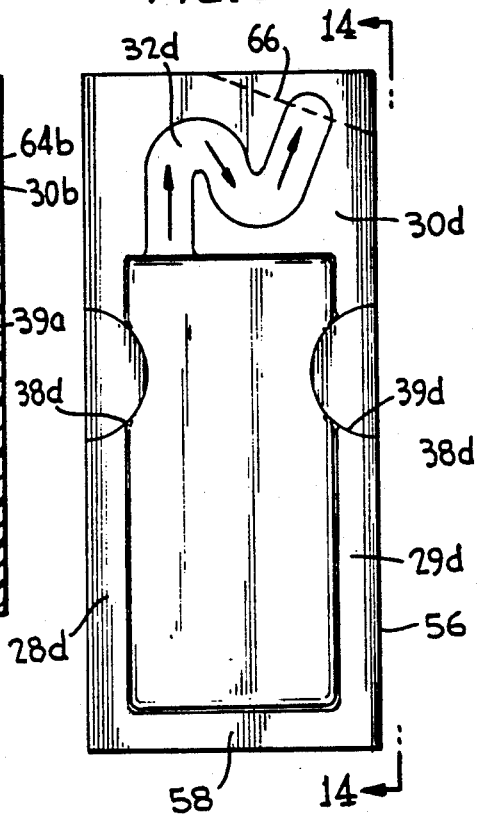
FIG. 10 is a frontal view of still another embodiment of the fluid container of the present invention.
Figure 14:
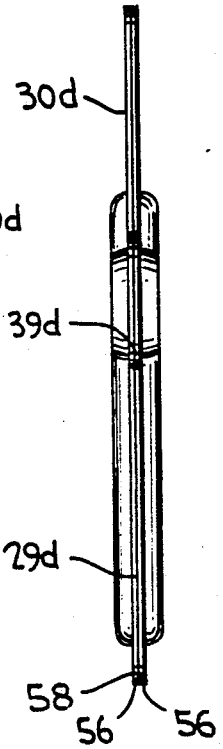
FIG. 14 is a side view, taken from the plane 14—14, of that embodiment of the fluid container which is shown in FIG. 10.

As was briefly mentioned above, the fluid container of the present invention need not have a free-standing base; but rather, can have a simple, closed bottom, as those embodiments presented in FIGS. 9 and 10 illustrate. Indeed, for convenience, the flexible-plastic fluid container of the present invention can readily be constructed so as to be relatively thin (FIG. 14), so as to conveniently fit in a consumer's shirt pocket or lady's purse.

Figure 11:
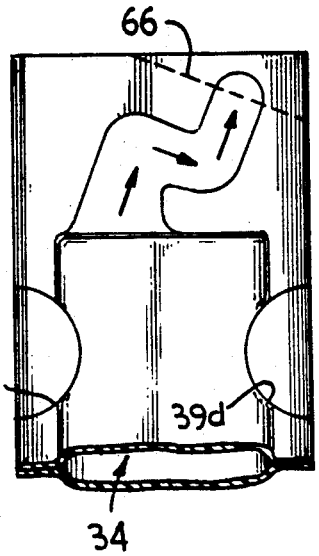
FIG. 11 is a partially-fragmented frontal view of yet another embodiment of the fluid container of the present invention.

One such envelope-like flexible-plastic fluid container embodiment of the present invention comprises two flexible-plastic sheets 56 sealed together along their bottom margin 58, side margins 28d and 29d, and upper margin 30d. (Please refer to FIGS. 10 and 14.) The side margins 28d and 29d define the indents 38d and 39d. The upper margin 30d defines the fluid-discharge passageway 32d. The plastic sheets 56 define a fluid-containing cavity. One such cavity 34 is illustrated in the envelope-type of fluid container embodiment that is shown in FIG. 11.

The general shape and diameter of the fluid-discharge passageway is a matter of design choice, as will be understood by those skilled in the art. For example, the diameter of the fluid-discharge passageway can be relatively small (FIG. 9), can be relatively large (FIG. 11) or can be of intermediate diameter (FIG. 10). That end portion of the fluid-discharge passageway which communicates with the upper fluid chamber of the fluid cavity, moreover, can be arranged generally along the longitudinal axis X—X, as is shown in FIG. 9, or can be generally spaced therefrom (see, e.g., FIGS. 10 and 11.)

Generally, the upper margin is formed in a manner such that the fluid-discharging end of the fluid passageway is initially sealed. Referring initially to FIGS. 1 and 2, for example, the fluid-discharging end 64a, originally sealed, is so formed as to be rupturable when pressure in the fluid-discharge passageway 32a (FIG. 2) reaches a predetermined value. In particular, upon achieving such a pressure in the fluid-discharge passageway 32a, the fluid-discharging end 64a opens. Such rupturable seals are well known in the art. See, e.g., U.S. Pat. No. 4,537,308 to Hollander, Jr.

Still, in other situations, it is desirable to cut the upper-edge margin 30d along an indicated cut line 66 (see, e.g., FIGS. 10 and 11) to open the sealed fluid-discharge passageway.

Yet, in still other situations, it is desirable to so form the upper-edge margin 30b such that the margin 30b not only defines the fluid-discharge passageway 32b but also defines a so-called "tear-away" tab 68. In particular, such an edge margin 30b further preferably defines a preformed score line 70, so formed in the upper-edge margin 30b as to enable the tab 68 to readily be removable from the remainder of the margin 30b (along the score line 70) while opening the fluid-discharging end 64b of the fluid-discharge passageway 32b. (Please refer to FIG. 9.)

What has been illustrated and described herein is an improvement in certain types of squeezable articles of manufacture such as fluid containers made of flexible-plastic material. While the improvements have been illustrated and described with reference to certain preferred embodiments, the present invention is not limited thereto. In particular, the foregoing specification and embodiments are intended to be illustrative and are not to be taken as limiting. Thus, alternatives, such as structural or mechanical equivalents, and other modifications will become apparent to those skilled in the art upon reading the foregoing description. Accordingly, such alternatives, changes and modifications are to be considered as forming a part of the present invention insofar as they fall within the spirit and scope of the appended claims.

We claim:

1. In a squeezable plastic pouch-like article of manufacture defining a cavity for containing a dispensable fluid and having flexible sidewalls, a bottom, a pair of spaced-apart outwardly-extending deformable side-edge margins, and a deformable upper-edge margin which is unitary with the side-edge margins and which defines a fluid passageway means that is able to communicate with the fluid cavity, wherein deformation of the upper-edge margin in the vicinity of the inlet of the fluid passageway means tends to block fluid communication between the fluid passageway means and the fluid cavity, wherein the improvement comprises:

the fluid passageway means being defined by a minor portion of the surface area of the deformable upper-edge margin, wherein the fluid discharge means is of generally serpentine configuration and has a fluid discharge end;

deformation-causing means defined by at least one of the outwardly-extending side-edge margins and spaced from the upper-edge margin by a distance that is effective for causing deformation to occur in the side-edge margin that is in the vicinity of the deformation-causing means, rather than in the vicinity of the generally serpentine fluid passageway means, upon application of a predetermined squeezing pressure to the cavity-contained fluid via the article sidewalls, for purposes of enabling fluid to be discharged from the fluid-discharge end of the fluid passageway means;

whereby fluid communication between the generally serpentine fluid passageway means and the fluid cavity is maintained upon application of the predetermined squeezing pressure to the cavity-contained fluid via the article sidewalls.

2. The article of manufacture of claim 1 wherein the article of manufacture is a flexible-plastic fluid container, and wherein the bottom of the fluid container defines a free-standing base.

* * * * *

UNITED STATES PATENT AND TRADEMARK OFFICE

CERTIFICATE OF CORRECTION

PATENT NO. : 5,018,646

DATED : May 28, 1991

INVENTOR(S) : F.L. Billman, M.D. Jamison and R.B. Wortley

It is certified that error appears in the above-identified patent and that said Letters Patent is hereby corrected as shown below:

Col. 1, line 62, please insert the word -- be -- between the words "to" and "made" (appearing at the beginning of the line).

Signed and Sealed this

Twenty-ninth Day of September, 1992

*Attest:*

DOUGLAS B. COMER

*Attesting Officer*

*Acting Commissioner of Patents and Trademarks*